US006161335A

United States Patent [19]

Beard et al.

[11] Patent Number: 6,161,335

[45] Date of Patent: Dec. 19, 2000

[54] BALANCE SHOE FOR REDUCING THE SIZE OF A PIVOTABLE WINDOW SASH ASSEMBLY

[75] Inventors: Gene Beard; Scott Beard, both of Lewisburg, W. Va.; Colin Slocomb, Wilmington, Del.

[73] Assignee: CSB Enterprise, Inc., Wilmington, Del.

[21] Appl. No.: 09/452,958

[22] Filed: Dec. 2, 1999

[51] Int. Cl.[7] ..... E05D 15/22

[52] U.S. Cl. ..... 49/181; 49/176

[58] Field of Search ..... 49/181, 176; 16/193, 16/DIG. 16

[56] References Cited

U.S. PATENT DOCUMENTS

| | | | |
|---|---|---|---|
| 4,493,128 | 1/1985 | Corry | 16/197 |
| 4,958,462 | 9/1990 | Cross | 49/181 |
| 5,127,192 | 7/1992 | Cross | 49/181 |
| 5,377,384 | 1/1995 | Riegelman | 16/193 |
| 5,632,118 | 5/1997 | Stark | 49/181 |
| 5,704,165 | 1/1998 | Slocomb et al. | 49/181 |
| 5,806,243 | 9/1998 | Prete et al. | 49/181 |
| 5,943,822 | 8/1999 | Slocomb et al. | 49/181 |

*Primary Examiner*—Daniel P. Stodola
*Assistant Examiner*—Gregory J. Strimbu
*Attorney, Agent, or Firm*—Connolly Bove Lodge & Hutz

[57] ABSTRACT

A balance shoe for a pivotable window sash assembly includes a base unit at the lower end of the balance shoe. The base unit includes a fixed wall having a movable wall connected thereto by a connecting structure. A cam is disposed between the fixed wall and the movable wall for moving the movable wall with respect to the fixed wall while the connecting structure maintains the movable wall in a generally parallel relationship with the fixed wall. The cam extends beyond the upper edge of the fixed wall and the movable wall. This arrangement of elements permits a smaller window to be used while still providing the same egress area when the window is open as compared to conventional window assemblies.

16 Claims, 3 Drawing Sheets

BALANCE SHOE FOR REDUCING THE SIZE OF A PIVOTABLE WINDOW SASH ASSEMBLY

BACKGROUND OF INVENTION

Various types of window assemblies exist including a pivotable window sash assembly which has a tilt window mounted to a channeled window frame. In use, the window sash would move up and down and would also be capable of pivoting outwardly with respect to the window frame for access, for example, in cleaning the window. A conventional mechanism for accomplishing these movements is to include a balance shoe which is mounted for slidable movement in a channel in the window frame. A pivot bar is secured to the window sash and is engaged with the balance shoe. In this manner the balance shoe moves in the channel which acts as a track during the up and down movement of the window sash.

Various regulations exist requiring a minimum size opening for the window to permit egress. This, in turn, requires a minimum size window. It would be desirable from a cost and aesthetic standpoint if these egress regulations could be met with smaller size windows.

SUMMARY OF INVENTION

An object of this invention is to provide a balance shoe which permits the use of a smaller size window that still meets egress requirements.

A further object of this invention is to provide such a balance shoe which may effectively operate in conjunction with a pivot bar to permit the proper movements of the window sash assembly.

In accordance with this invention the balance shoe includes a generally U-shaped frame having spaced side walls interconnected by a top wall with the lower end of the side walls interconnected by a base unit. The base unit is comprised of a fixed wall having an opening which would be disposed toward the pivot bar. The base unit also includes a movable wall generally parallel to and spaced from the fixed wall. A cam is rotatably mounted in the spacing between the fixed wall and the movable wall. The rotatable cam has a projection which is rotatably mounted in the opening of the fixed wall. The projection includes a keyway which receives the pivot bar to selectively rotate the cam upon rotation of the pivot bar during the tilting action of the window sash. A notch is provided in the cam disposed toward the movable wall and a tongue on the movable wall is located in the path of rotational movement of the notch for selective engagement in the notch. The movable wall is mounted to the fixed wall in such a manner that the movable wall moves in and out toward and away from the fixed wall depending upon whether the tongue is in the notch or not in the notch.

The base unit is made of smaller size than conventional balance shoes whereby the base unit terminates at the top of the fixed wall opening. In a preferred practice of the invention serrations extend transversely across the moveable wall over the entire height of the movable wall.

THE DRAWINGS

DETAILED DESCRIPTION

The present invention is directed to improvements in balance shoes used for pivotable window sash assemblies. Exemplary construction of known pivotable window sash assemblies are found in U.S. Pat. Nos. 4,930,254, 5,069,001 and 5,237,775, the details of which are incorporated herein by reference thereto. Reference is also made to U.S. Pat. Nos. 5,704,165, 5,802,767, 5,927,013 and 5,943,822, which shows details of balance shoes and pivot bars generally of the type with which the present invention is directed. All of the details of those patents are incorporated herein by reference thereto.

Figure 2:
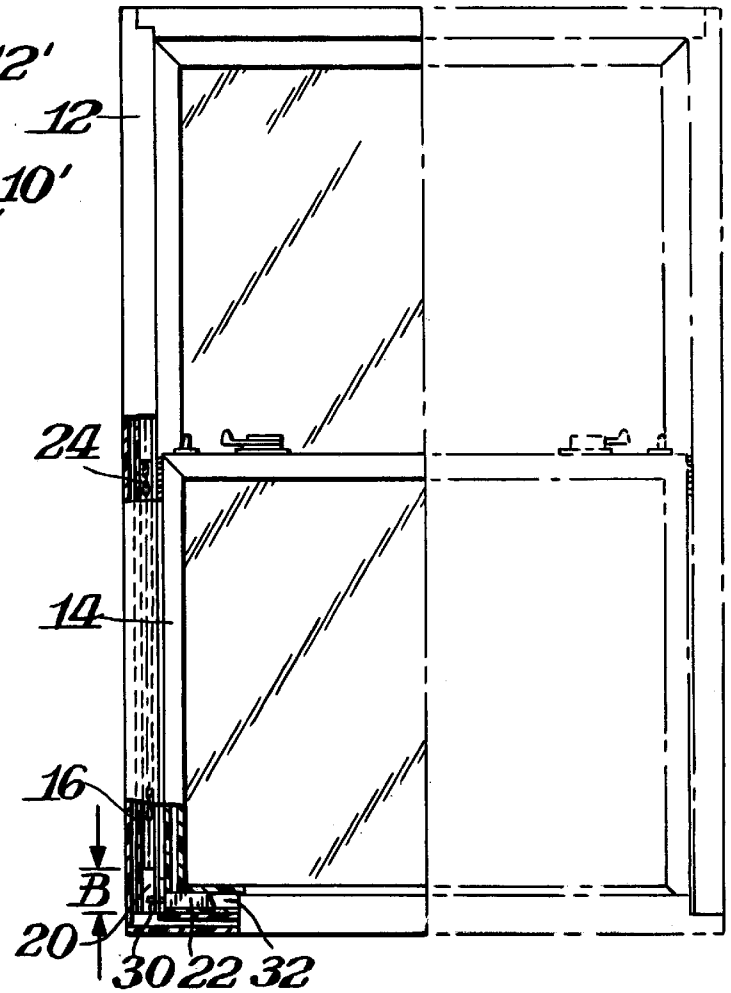
FIG. 2 is a view similar to FIG. 1 of a window sash assembly in accordance with the invention.
Figure 1:
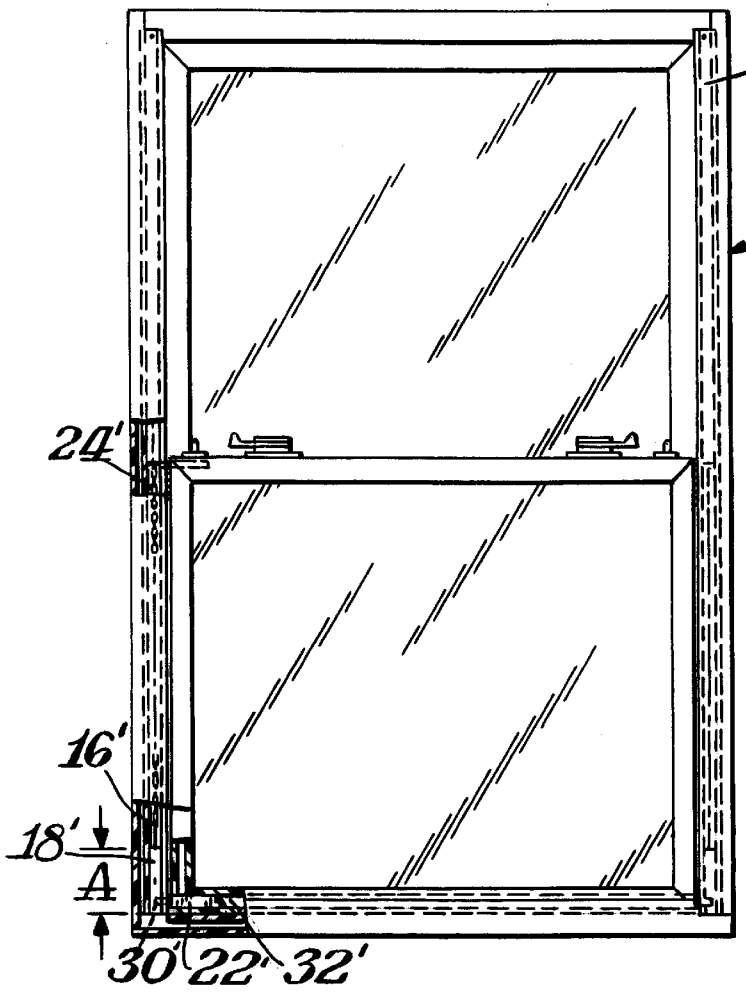
Fig.1(Prior Art)
FIG. 1 is a front elevational view party broken away of a closed pivotable window sash assembly in accordance with the prior art.
Figure 4:
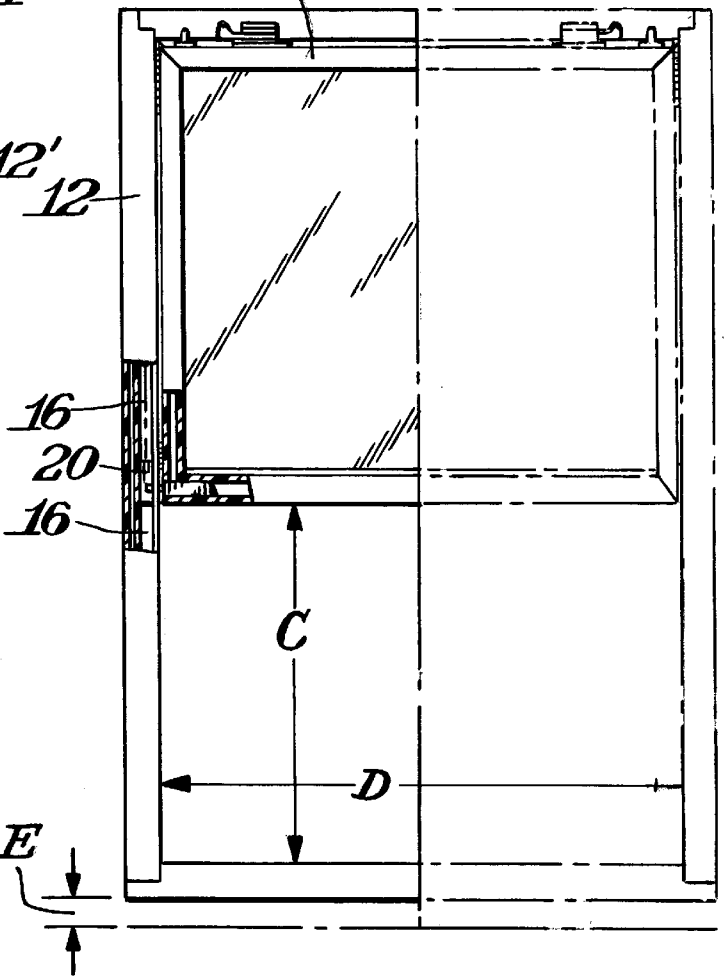
FIG. 4 is a view similar to FIG. 3 in accordance with the invention.
Figure 3:
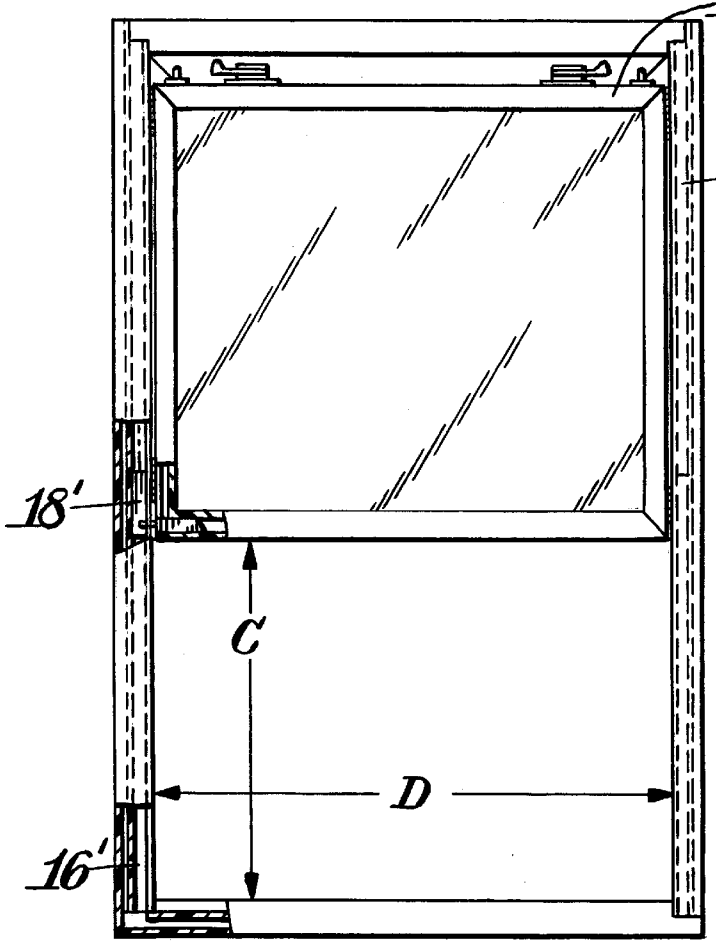
Fig. 3 (Prior Art)
FIG. 3 is a view similar to FIG. 1 of a prior art window sash assembly in the open condition.
Figure 9:
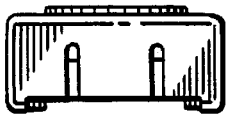
FIG. 9 is a top plan view of the balance shoe shown in FIGS. 6–8.
Figure 5:
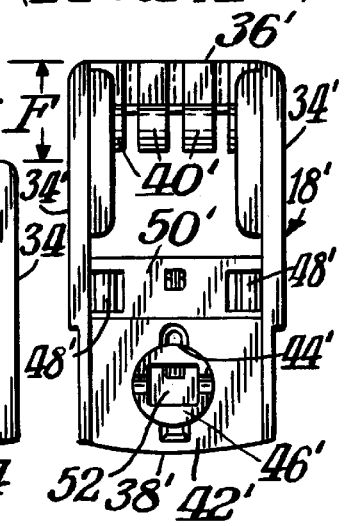
Fig. 5. (Prior Art)
FIG. 5 is a front elevational view of a prior art balance shoe.

FIGS. 1 and 3 illustrate a prior art pivotable window sash assembly in the closed and open positions, respectively, while FIGS. 2 and 4 are similar views of an assembly incorporating the balance shoe of this invention. As shown therein the pivotable window sash assembly 10 includes components which may be of known construction. For example, a main frame 12' is provided of any suitable material such as extruded PVC. Frame 12' is, for example, a master frame. The window sash 14' may also be an extruded PVC lift rail. Main frame 12' includes a plurality of channels. One of the channels is a channel 16' which serves as a track for a balance shoe. In FIGS. 1, 3 and 5 the prior art balance shoe is indicated by the reference numeral 18, while the balance shoe of this invention is indicated by the reference numeral 20. Balance shoe 18 or 20 would slide in track 16 under the influence of winder 24.

Lift rail window sash 14' contains a pivot bar 22' of the type disclosed in the aforenoted patents. Pivot bar 22' is inserted into the hollow window sash 14' into opening 32'. Pivot bar 22' includes an extension 30' which fits into an opening in the balance shoe as later described.

During the opening and closing of the window, the sash 14' or 14 would be raised vertically while pivot bar extension 30' or 30 is engaged in balance shoe 18 or 20. FIGS. 3 and 4 show the window sash 14' or 14 in its completely raised condition. When in the raised condition an opening exists in the window frame to permit egress from the window. The area of the opening is defined by the dimensions C and D. Various egress regulations require that the resulting area meet minimum standards, such as 5.7 sq. feet.

In accordance with this invention window sash 14 may be of smaller size than the conventional window sash shown in FIGS. 1 and 3 while still resulting in the same egress open area. This is achieved by providing balance shoe 20 which is of an overall height indicated by the letter B in FIG. 2 which is smaller than the overall height A of balance shoe 18 shown in FIG. 1. As a result, the overall height of the window sash assembly for the invention shown in FIGS. 2 and 4 would be the dimension E as compared to the overall height of the conventional assembly shown in FIGS. 1 and 3. As later described, in the preferred practice of the invention the height is reduced by ⅝ inches because the invention permits further movement of the window sash 14 into the open position by a distance E which is the difference in height of the balance shoe 20 as compared to the balance shoe 18. By having further upward movement of the bottom sash 14, the egress opening remains the same.

FIG. 5 illustrates a known prior art balance shoe 18. As shown therein balance shoe 18 is generally formed by a U-shaped frame having side walls 34',34' interconnected at their upper end by top wall 36'. The lower ends of the side walls 34',34' is interconnected by a base unit 38. Springs 40' are mounted to top wall 36'. Base unit 38 includes a fixed wall 42 having an opening 44 for receiving a cam projection 46' from a cam located between the fixed wall 42 and a movable wall (not shown) disposed generally parallel and spaced from the fixed wall. The movable wall is pivotally mounted to fixed wall 42 by pivot pins 48 in base extension 50. The cam projection 46 includes a keyway 52' for receiving the pivot bar extension to interlock the pivot bar and balance shoe in a known manner. Thus, the interlocking of the pivot bar and balance shoe permits the sash 14' to be moved up and down while the balance shoe 18 slides in track 16'. When it is desired to tilt the sash 14', the rotational movement of the pivot bar causes the cam to rotate and when a tongue on the movable wall is moved out of a notch in the cam, the movable wall pivots about pivot pins 48,48 in a rotational movement away from fixed wall 42 in a known manner. Although not illustrated the lower portion of the movable wall would include horizontal serrations or grooves on its outer surface for locking purposes.

FIGS. 6–11 show the details of the balance shoe 20 in accordance with this invention. As illustrated therein, many of the details of balance shoe 20 are similar to those of prior art shoe 18. Thus, balance shoe 20 includes a U-shaped frame having side walls 34,34 with an interconnecting top wall 36 provided with springs 40. The base unit 54 of balance shoe 20, however, would significantly differ from base unit 38 of prior art balance shoe 18, as later described.

Figure 7:
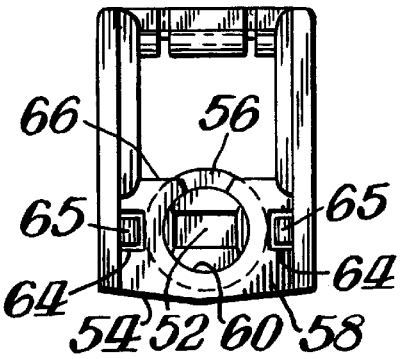
FIG. 7 is a front elevational view of the balance shoe shown in FIG. 6.
Figure 8:
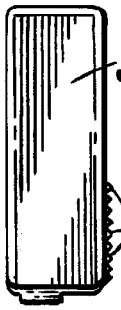
FIG. 8 is a right side elevational view of the balance shoe shown in FIGS. 6–7.
Figure 11:
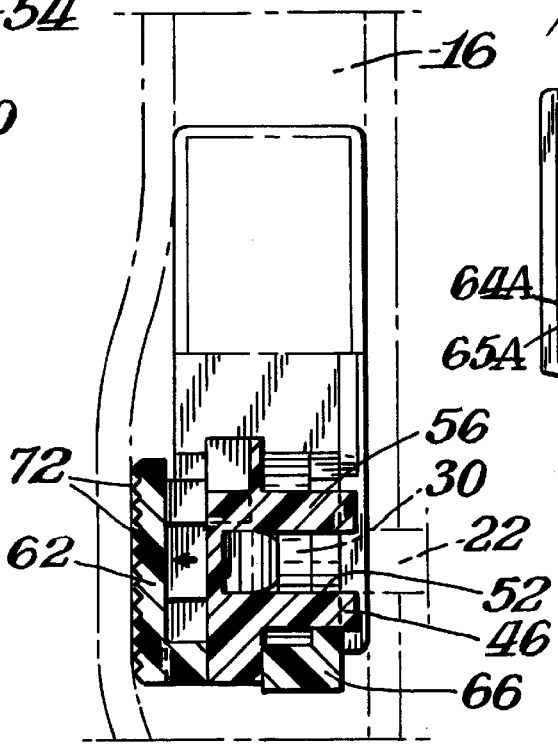
FIG. 11 is an enlarged left side elevational view partly broken away of the balance shoe shown in FIGS. 6–10.

FIG. 11 best illustrates the interaction of the pivot bar 22 with the cam 56. As shown therein and as shown in FIG. 7, fixed wall 58 includes a circular opening 60 through which the projection 46 of cam 56 would extend. Projection 46 would include a keyway 52 for receiving the extension 30 of pivot bar 22. The keyway and pivot bar extension may take the various forms disclosed in the above noted patents.

A significant difference between balance shoe 20 and prior art balance shoe 18 is in the structure of the base unit and of the movable wall. Base unit 54 omits the base extension 50 provided for prior art balance shoe 18. This is possible by mounting movable wall 62 for movement in an in and out direction rather than a pivotable movement. In order to achieve this in and out movement slots 64 are formed on each side of base unit fixed wall 58. Slide pins 65 are integrally formed on movable wall 62 and are disposed to slide within slots 64. Alternatively slots 64A may be provided on the movable wall of balance shoe 20A to receive pins 65A secured to fixed wall to effect the sliding movement as shown in FIG. 6A.

Figure 10:
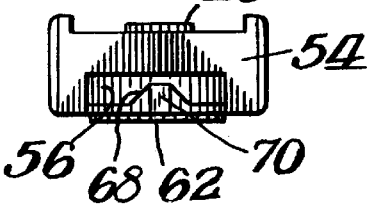
FIG. 10 is a bottom plan view of the balance shoe shown in FIGS. 6–9.

FIG. 10 illustrates the cam 56 to include a notch 68, while a tongue 70 is provided on movable wall 62. When tongue 70 is mounted in notch 72 the movable wall 62 is at its closest position with respect to fixed wall 58. When the pivot bar rotates, the cam 56 also rotates and the tongue 70 is moved out of notch 68 thus causing movable wall 62 to move away from fixed wall 58. With a prior art type balance shoe the movement of the movable wall would be a rotational or pivotable movement. The connecting structure for movable wall 62 to fixed wall 58, however, is an in and out movement where the movable wall is always generally parallel to the fixed wall.

In accordance with the invention by eliminating the base unit extension it is possible to shorten the height of the balance shoe. Thus, the height of the base unit could be reduced to a size where the projection 46 of the cam 56 is exposed from or extends outwardly beyond the top edge 66 of the fixed wall 58 and the movable wall 62. This difference in height is indicated by the letter F in showing the side by side comparison of prior art balance shoe 18 in FIG. 5 and the balance shoe 20 of this invention in FIG. 6.

If desired the slide pins 65 may include flanges or extensions which would engage stop projections within slots 64 to prevent the slide pins from being removed from the slots and thus assure maintaining the movable wall and fixed wall mounted together. The slide pins could have sufficient resiliency to facilitate bending the slide pins toward each other when mounting the movable wall to the fixed wall by inserting the slide pins 65 into the slots 64.

Pins 65 are preferably located midway the height of movable wall 62. If desired the pins may be connected to the fixed wall 58 and the slots may be in the movable wall.

Figure 6:
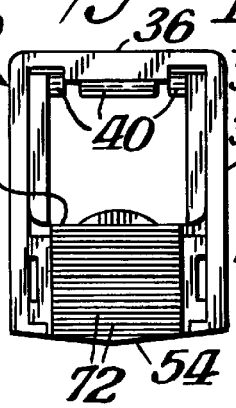
FIG. 6 is a rear elevational view of a balance shoe in accordance with this invention.
Figure 6A:
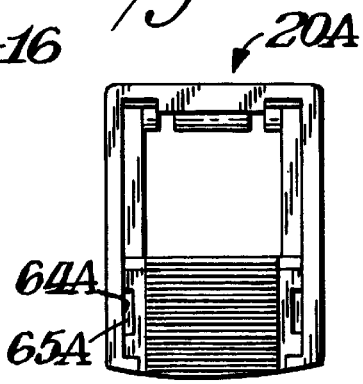
FIG. 6A is a view similar to FIG. 6 of a modified form of balance shoe in accordance with this invention.

As best illustrated in FIGS. 6 and 11 a further feature of the invention is that, because the movable wall 62 is always in a position generally parallel to the fixed wall 58, the entire outer surface of movable wall 62 could be provided with serrations or ribs 72 extending in a generally horizontal direction over the entire height of the movable wall rather than being confined in the lower portion of the movable wall as with prior art balance shoe 18. The provision of the serrations or ribs 72 over the entire surface of the movable wall 62 also provides for better engagement with the frame channel as shown in FIG. 11.

The overall height of a conventional balance shoe 18 is about 2¼ inches. The overall height with the balance shoe 20 of the invention is reduced to less than 2 inches and preferably to 1⅝–1⅞ inches and more preferably 1⅝ inches thereby permitting the sash to be moved an extra distance of ⅜–⅝ inches for permitting a smaller sash to result by that same distance.

As a result of the modified balance shoe 20 of this invention less material is used for the balance shoe and a small sash may be used resulting on significant cost reduction which could amount to about $1.00–$2.00 per window.

What is claimed is:

1. A balance shoe comprising a frame having spaced side walls interconnected by a top wall at an upper end of said frame, a base unit interconnecting said side walls at a lower end of said frame, said base unit having a fixed wall with an opening for being disposed toward a pivot bar, said base unit having a movable wall generally parallel to and spaced from said fixed wall, a cam mounted in the spacing between said fixed wall and said movable wall, said cam having a projection rotatably mounted in said opening of said fixed wall, a keyway in said projection for receiving the pivot bar therein to selectively rotate said cam upon rotation of the pivot bar, a notch in said cam disposed toward said movable wall, a tongue on said movable wall located in a path of rotational movement of said notch for selective engagement in said notch, each of said fixed wall and said movable wall having a lower edge remote from said upper end of said frame, each of said fixed wall and said movable wall having an upper edge between said lower edge and said upper end of said frame, said cam extending to at least said upper edge of each of said fixed wall and said movable wall, and a connecting structure mounting said movable wall to said fixed wall for selective movement of said movable wall parallel to said fixed wall toward and away from said fixed wall in an in and out direction.

2. The balance shoe of claim 1 wherein said opening intersects the upper edge of said fixed wall.

3. The balance shoe of claim 2 wherein said projection is mounted completely within said opening and a portion of said cam extends outwardly beyond said opening.

4. The balance shoe of claim 2 wherein said frame is between 1⅝ and 1⅞ inches in overall height.

5. The balance shoe of claim 2 wherein said frame is about 1⅝ inches in overall height.

6. The balance shoe of claim 2 wherein said frame is less than two inches in overall height.

7. The balance shoe of claim 6 wherein said connecting structure comprises slots in one of said fixed wall and said movable wall, and pins on the other of said fixed wall and said movable wall slidably mounted in said slots.

8. The balance shoe of claim 7 wherein said slots are in said fixed wall, and said pins are on said movable wall.

9. The balance shoe of claim 8 wherein said pins include locking edges, said slots include stop projections engageable with said locking edges, and said pins being resilient to permit insertion of said pins into said slots.

10. The balance shoe of claim 7 including serrations extending transversely across an outer surface of said movable wall over the entire height of said movable wall.

11. The balance shoe of claim 1 wherein said frame is less than two inches in overall height.

12. The balance shoe of claim 1 wherein said connecting structure comprises slots in one of said fixed wall and said movable wall, and pins on the other of said fixed wall and said movable wall slidably mounted in said slots.

13. The balance shoe of claim 1 including serrations extending transversely across an outer surface of said movable wall over the entire height of said movable wall.

14. The balance shoe of claim 1 wherein said cam extends outwardly beyond said upper edge of each of said fixed wall and said moveable wall.

15. In a window sash assembly wherein said window sash assembly includes a main frame, a balance shoe being mounted in said main frame, said window sash assembly further including a lift rail, a pivot bar mounted in said lift rail, and said pivot bar having an extension, said balance shoe comprising a frame having spaced side walls interconnected by a top wall at an upper end of said frame, a base unit interconnecting said side walls at a lower end of said frame, said base unit having a fixed wall with an opening for being disposed toward said pivot bar, said base unit having a movable wall generally parallel to and spaced from said fixed wall, a cam mounted in the spacing between said fixed wall and said movable wall, said cam having a projection rotatably mounted in said opening of said fixed wall, a keyway in said projection for receiving said extension of said pivot bar therein to selectively rotate said cam upon rotation of said pivot bar, a notch in said cam disposed toward said movable wall, a tongue on said movable wall located in a path of rotational movement of said notch for selective engagement in said notch, each of said fixed wall and said movable wall having a lower edge remote from said upper end of said frame, each of said fixed wall and said movable wall having an upper edge between said lower edge and said upper end of said frame, said cam extending to at least said upper edge of each of said fixed wall and said movable wall, and a connecting structure mounting said movable wall to said fixed wall for selective movement of said movable wall toward and away from said fixed wall in an in and out direction.

16. The assembly of claim 15 wherein said window sash assembly has a window opening of about 5.7 sq. ft. to comprise an egress exit when said lift rail is completely raised.

* * * * *